United States Patent [19]

Tucker et al.

[11] 4,208,170

[45] Jun. 17, 1980

[54] BLADE RETAINER

[75] Inventors: James W. Tucker, Forest Park; Robert A. Peck, Loveland, both of Ohio

[73] Assignee: General Electric Company, Cincinatti, Ohio

[21] Appl. No.: 907,238

[22] Filed: May 18, 1978

[51] Int. Cl.[2] ..... F01D 5/32

[52] U.S. Cl. ..... 416/221

[58] Field of Search ..... 416/221, 220 R, 220 A

[56] References Cited

U.S. PATENT DOCUMENTS

| | | | |
|---|---|---|---|
| 2,786,648 | 3/1957 | Ledwith | 416/221 |
| 2,828,942 | 4/1958 | McCullough et al. | 416/221 |
| 2,847,187 | 8/1958 | Murphy | 416/221 |
| 2,928,651 | 3/1960 | Turnbull | 416/221 |
| 3,353,788 | 11/1967 | Weeds | 416/221 |
| 3,479,009 | 11/1969 | Bean | 416/221 |
| 3,572,970 | 3/1971 | Smuland | 416/221 |
| 3,598,503 | 8/1971 | Muller | 416/221 |
| 3,832,094 | 8/1974 | Manharth | 416/220 |
| 3,936,234 | 2/1976 | Tucker et al. | 416/221 |
| 4,102,602 | 7/1978 | Rottenkolber | 416/221 |

FOREIGN PATENT DOCUMENTS

| | | | |
|---|---|---|---|
| 1491480 | 11/1977 | United Kingdom | 416/221 |

*Primary Examiner*—Everette A. Powell, Jr.
*Assistant Examiner*—A. N. Trausch, III
*Attorney, Agent, or Firm*—Robert C. Lampe, Jr.; Donald W. Walk; Derek P. Lawrence

[57] ABSTRACT

An improved blade retainer for locking radially projecting blades on a rotor includes an elastic spacer sized to be inserted into a radial space between the blade tang and the bottom of the rotor slot in a generally undeformed state without deformation of the tang or slot. The spacer is provided with a first arcuate surface which abuts the tang and a second arcuate surface which, in one embodiment, abuts the bottom of the rotor slot when the spacer is deformed, thereby exerting an outwardly directed load on the tang. The spacer is fixed against axial movement relative to the blades by means of a forward end lug which is in confronting and overlapping relationship with an end face on the blade tang when the spacer is deformed. Blocker means are insertable between the spacer and the bottom of the slot to retain the spacer in a deformed state and thereby bias the blade radially outwardly. A channelled sleeve can be provided under the spacer and blocker means to distribute the load over a greater area of the rotor slot to reduce wear thereof.

8 Claims, 12 Drawing Figures

64
52
46
48
96
90
50
65
70
62
66
58
74
65
76
108
54
138

12
126
18
48
96
58
104
54
98
52
12
12

14
16
9
18
66
74
92
64
72
48
116
46
76
78
90
84
86
52
118
94
102
106
56
98
9
12

18
65
65
64
20
42
48
44
68
12

120
134
132
122
124
126
130
18
64
136
116
100
72
48
128
78
90
84
86
98
54
110
76
118
92
52
104
102
94
113
108
138
106
46
12

18
112
67
64
90
67
88
68
48
114
56
82
12
52
84
44

124
126
122
72
48
136
134
14
16
120
124
126

18
52
64
48
42
67
67
68
52
50
114
56
54
12
44
89

BLADE RETAINER

The invention herein described was made in the course of or under a contract, or a subcontract thereunder, with the U.S. Department of the Air Force.

BACKGROUND OF THE INVENTION

The present invention relates to turbomachines and, more particularly, to improved means for retaining rotor blades in rotor slots.

In the manufacture of bladed turbomachinery rotors, retention of the blades on a rotor, such as a turbine or fan rotor, has been commonly accomplished by insertion of metal strips within the rotor slot and subsequent bending of the ends of the metal strip such that the ends overlap the base of the blade and the radially extending faces of the rotor. These retainers have exhibited features which have proven to be undesirable. An example of one such undesirable feature is that loads tending to displace the rotor blade from its slot are absorbed by the bent ends of the metal strip. Since the metal strips have generally been designed to easily accommodate bending upon installation, they are susceptible to bending in opposite directions due to forces applied by the rotor blade.

Other undesirable features are associated with servicing of the rotor blade. Removal of the prior art devices during routine maintenance has proven troublesome since access, which in many instances cannot be conveniently provided, is required at both sides of the rotor disk. Furthermore, the prior art devices as described above are not suitable for re-use because of alterations in the physical and metallurgical properties associated with repeated bending of the ends of the retainers upon removal and reinstallation of the blades. The attendant replacement of the retainers is costly, especially if a substantial number of blades must be removed for servicing.

Other prior art devices, such as that shown in U.S. Pat. No. 3,936,234, have served generally to advance the state of the art in blade locking and retaining devices. However, while such a device provides excellent blade retention capacity with respect to the rotor disk, evidence has shown that a small amount of tangential freedom of the blade within the rotor disk slot permits relative motion to occur between the blade dovetail and the rotor disk during periods of windmilling rotation of the gas turbine engines. These periods may be as long as eight to twelve hours per day, and the resulting blade motion results in wear of a protective coating which is normally applied to the rotor disk slots. Loss of the coating permits galling wear of the disk dovetail pressure face. Repair of the disk dovetails is inconvenient, expensive, and can only be repeated a few times before the rotor disk becomes unserviceable.

The prior art device of U.S. Pat. No. 3,936,234 includes a biasing wedge comprised of a resilient material capable of elastic deformation which is inserted into a recess between the blade retainer and the bottom of the rotor disk slot to produce a radially outwardly directed load on the blade through compression of the biasing material. In the design of this prior art device, the elastic material should preferably have a low stiffness in order to permit compression over a tolerance range of slot gaps, and the material should be soft in order to prevent physical damage to the rotor disk slot bottom when the retainer spacer is installed. Current practice is to utilize an organic polymeric material such as nylon 6/6 in compression to provide the radial loading. The radial load that can be generated from a nylon-type of polymer is limited by the driving force required to install the retainer spacer. The use of soft compressive, non-metallic (or low strength) materials permits material creep at ambient temperatures and, combined with the radial compression that generates the loading, allows a minute amount of dovetail wear to loosen the system and reduce its effectiveness.

It might appear, therefore, that it would be desirable to provide the current prior art device with a hard, metallic, high-strength insert. However, such a combination: would inevitably damage the disk slot bottom during installation if, in fact, the insert could be driven into place; would be unable to compensate for slight differences in dovetail manufacturing tolerances; and, would be very difficult to remove.

SUMMARY OF THE INVENTION

Accordingly, it is the primary object of the present invention to provide an improved blade locking device having a spacer which biases the blade radially outwardly to eliminate relative motion between the blade dovetail and the rotor disk during normal rotor operations, including windmilling.

It is a further object of the present invention to provide an improved blade locking device having an improved metallic spacer which compensates for rotor disk slot tolerance variation while biasing the blade radially outwardly.

It is still another object of the present invention to provide a blade retainer with an improved spacer which is easily installable without detrimental deformation of either the blade dovetail or the rotor disk slot.

These and other objects and advantages will be more clearly understood from the following detailed description, drawings and specific examples, all of which are intended to be typical of rather than in any way limiting to the scope of the present invention.

Briefly stated, the above objectives are accomplished in one embodiment of the present invention which provides a device for locking radially projecting blades on a rotor, each blade having a dovetail tang at its radially inward end and the rotor having dovetail slots extending across its periphery from one side of the rotor to the other, each dovetail tang being received within one of the slots with a radial space between the tang and the bottom of the slot. The locking device comprises a pair of spaced-apart retaining members residing in the radial space and each having enlarged end portions protruding from the slot which are in confronting and overlapping relationship with the end of the blade dovetail and the sides of the rotor disk to limit axial movement of the dovetail tang within its respective slot. The retaining members are spaced from one another by a generally bowed metallic spacer sized to be inserted into the radial space in a generally undeformed state without incurring deformation of the slot or tang. The spacer has elastic properties such that when the spacer is deformed to a generally straight configuration, a first arcuate spacer surface abuts the blade tang and a second arcuate spacer surface abuts the bottom of the slot to exert an outwardly directed load upon the tang. Load generation is accomplished in bending and this mechanism, in combination with the arcuate spacer surfaces, compensates for slot tolerance variations. A tool is used to deform the spacer by bending and the reaction load of the tool is replaced by a block which permits removal of the tool while maintaining spacer deformation and blade loading. The block and spacer are held from axial movement relative to the retaining members. A channelled sleeve may be provided under the spacer and block to distribute the reaction force over a greater area of the rotor slot.

BRIEF DESCRIPTION OF THE DRAWINGS

While the specification concludes with claims particularly pointing out and distinctly claiming the subject matter which is regarded as part of the present invention, it is believed that the invention will be more fully understood from the following description of the preferred embodiment which is given by way of example with the accompanying drawings in which:

DESCRIPTION OF THE PREFERRED EMBODIMENT

Figures 1, 2, 3, 4:
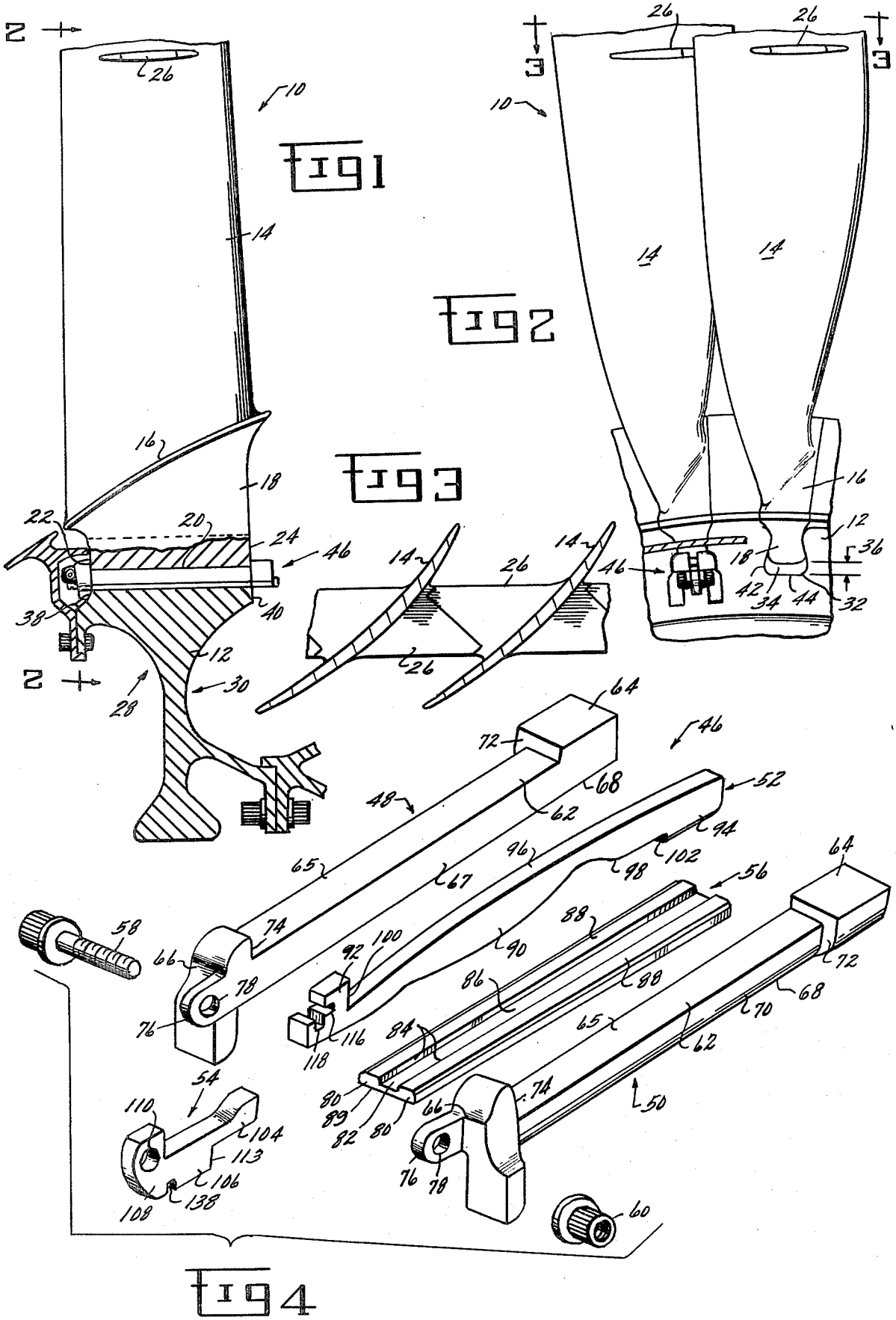
FIG. 1 is a radial cross-sectional view of a blade and rotor combination to which the present invention has been applied.
FIG. 2 is an axial view along line 2—2 of FIG. 1 of a rotor stage incorporating the improved blade retaining means according to the present invention.
FIG. 3 is a view along line 3—3 of FIG. 2 disclosing the integral shroud structure of the blades.
FIG. 4 is an exploded perspective view of the retaining pins and the improved spacer member of the present invention.

Referring to the drawings wherein like numerals correspond to like elements throughout, attention is first directed to FIG. 1 wherein a rotor blade shown generally at 10 is depicted in combination with a rotor disk shown generally at 12, both of which during operation rotate about a central axis, not shown, in the usual manner of a turbomachine. Rotor blade 10, having a large radial dimension, is comprised of an airfoil 14, a platform 16 and a radially inwardly extending tang 18 comprised of radially inwardly facing surface 20 and forward and aft end faces 22 and 24, respectively. Shroud segment 26 cooperates with similar shroud segments of adjacent blades approximately at midspan of rotor blade 10 to render stability to blade 10, which otherwise would exhibit excessive deflection under operating conditions due to its large radial dimension and relatively small thickness.

Referring now to FIGS. 1 and 2, the rotor 12, having forward and aft facing sides shown generally at 28 and 30, respectively, includes a plurality of dovetail slots 32 (one of which is shown without a retaining member) each adapted to receive the tang 18 of a blade 10 in a retaining relationship. The rotor dovetail slots 32 extend across the periphery of the rotor 12 from forward side 28 to aft side 30 and are of such a depth that, upon receiving the tang 18 of blade 10, there is defined a space 34 having a predetermined radial height 36. Proximate the forward and aft end of slot 32, outwardly facing abutment surfaces 38 and 40 are provided on rotor sides 28 and 30, respectively. Space 34 serves the function of permitting individual blades to be moved radially inwardly with respect to the rotor prior to removal from the slot 32 in order to disengage the shroud segments 26 from contact with one another. FIG. 3 depicts a top view of adjoining blades disclosing the cooperation of mating segments of the midspan shrouds 26. In order to withdraw a blade axially, it is first necessary to remove the associated segment 26 from its interlocking relationship with similar segments. Slot 32 is of generally U-shaped cross-sectional configuration with walls 42 forming the legs of the "U" and bottom wall 44 of the slot forming the base of the "U."

Rotors of the variety described above generally rotate at extremely high velocities. As a result, in absence of effective means for maintaining axial blade position, the reaction of the airfoils to foreign object impingement, blade tip rub, blade vibration or reaction to the air would tend to drive the blades 10 out of slots 32. If such were to occur, extensive damage could be done to the associated engine and its surroundings. As a result, it has become necessary to devise effective and reliable means for maintaining the blades 10 in a fixed relationship with the rotor 12. Furthermore, the blades 10 must be so fixed within rotor 12 that relative motion is precluded between blade dovetails 18 and slots 32 in order to minimize wear of these components. The present invention accomplishes this by means of utilizing the space 34 and placing therein an improved locking device indicated generally at 46 that fixedly retains blade tang 18 within slot 32 in a positive, tight-fitting and selectively releasable manner.

Figure 5:
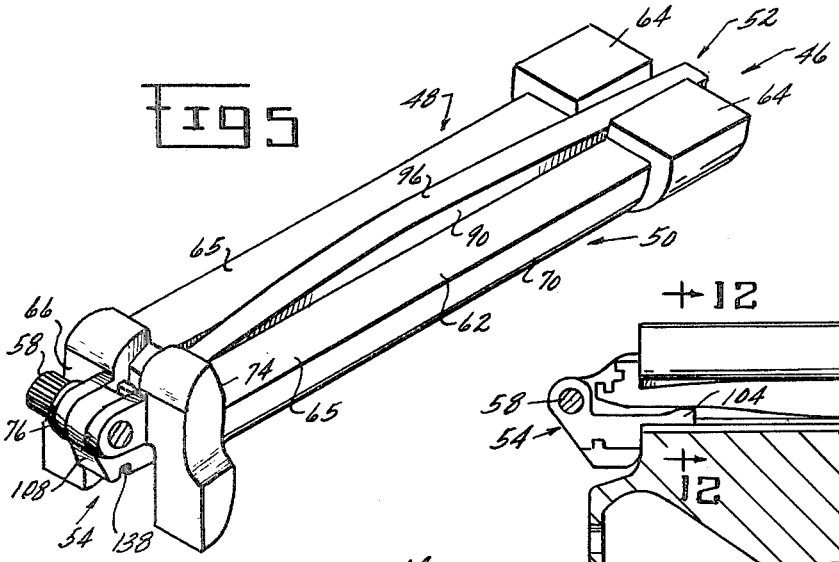
FIG. 5 is a perspective view of the retaining pins and the improved spacer member of the present invention in cooperative engagement.

Referring now to FIGS. 4 and 5, the improved locking device 46 is comprised of axially extending retaining members (or pins) shown generally at 48 and 50, axially extending spacer member shown generally at 52, spacer block 54, optional sleeve 56, bolt 58 and nut 60. Retaining members 48 and 50 are allochiral and are identical to those described in U.S. Pat. No. 3,936,234. Specifically, retaining members 48 and 50 have central elongated stem segments 62 of reduced cross section intermediate enlarged aft end portions (or lugs) 64 and forward end portions (or lugs) 66 at each end thereof. Forward end lugs 66 extend substantially in a radially outwardly and radially inwardly direction. The axial length of stem segments 62 is substantially equal to the axial length of slot 32. Each stem segment 62 has a radially outwardly facing bearing surface 65, a circumferentially inwardly facing side 67, a radially inwardly facing bearing surface 68 and a circumferentially outwardly facing side 70. Each aft end lug 64 is constructed to pass through space 34 while each forward end lug 66 is of a radial length greater than height 36. Hence, improper installation of the locking device and slot 32 is avoided. End lugs 64 and 66 cooperate with stem 62 to form inwardly facing abutment faces 72 and 74, respectively, which extend in a radial and circumferential direction. The axial distance between abutment faces 72 and 74 substantially equals the axial length of slot 32. Appendages 76, having apertures 78 extending therethrough, axially protrude from enlarged forward end lugs 66 of retaining members 48 and 50.

Sleeve 56, adapted to fit between bearing surfaces 68 of retaining members 48 and 50 and the bottom wall of slot 32 is provided with a pair of radially protruding lands 80 separated by an axially extending channel 82 with walls 84 forming the sides of the channel and bottom wall 86 forming its base. Each land has a radially outwardly facing surface 88 which is in proximity to and, at times, in engagement with a bearing surface 68. The sleeve is also provided with an inwardly facing surface 89 which is contoured to engage bottom wall 44 of slot 32. The axial length of sleeve 56 is substantially equal to the length of slot 32.

Figure 6:
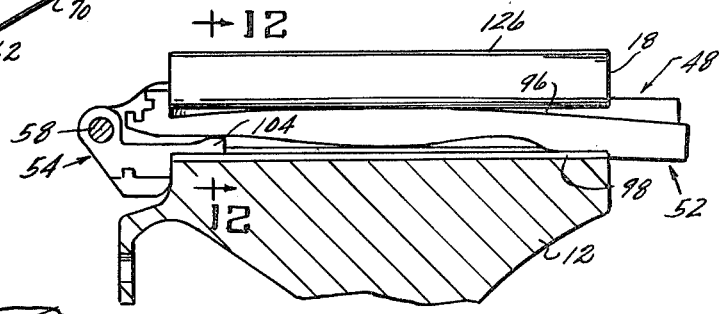
FIG. 6 is an enlarged view of the installed locking device, rotor slot and blade tang shown in the radial cross-sectional view of FIG. 1.
Figure 8:
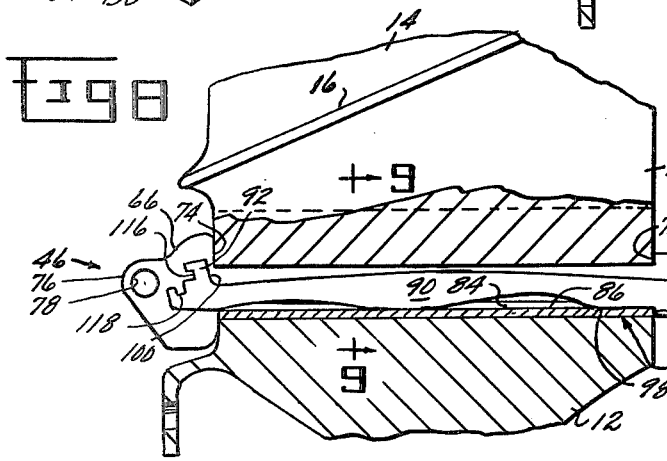
FIG. 8 is a side view in partial cross section showing the improved spacer member in its undeformed, installed position within the rotor slot.

Improved spacer member 52, adapted to fit between retaining members 48 and 50 and within sleeve channel 82, has an axially extending bowed central portion 90 which is generally tapered from a thicker radial dimension at the aft end to a thinner radial dimension at the forward end, with lug 92 integrally formed at the forward end thereof and lug 94 integrally formed at the aft end thereof. Spacer member 52 is provided with an upper, or first, arcuate surface 96 which, when installed is shown in FIG. 6, abuts blade tang 18 and a lower, or second, arcuate surface 98 which, when installed abuts the bottom wall 86 of channel 82. Aft end lug 94 is sized to pass through space 34 between retaining members 48 and 50, and the amount of bowing inherent in central portion 90 is limited to that which will permit spacer member 52 to fit within space 34 as shown in FIG. 8. End lugs 92 and 94 cooperate with central portion 90 to form inwardly facing abutment faces 100 and 102 which extend radially outwardly and inwardly, respectively. The axial distance between abutment faces 100 and 102 substantially equals the axial length of slot 32.

Spacer block 54, which comprises one example of a spacer means, also adapted to fit between retaining members 48 and 50 and within sleeve channel 82, and under spacer member 52 in a manner soon to be described, has an axially extending wedge portion 104 with lug 106 integrally formed at the forward end thereof. Appendage 108, having an aperture 110 extending therethrough, axially protrudes from spacer block 54. End lug 106 combines with wedge portion 104 to form an inwardly facing abutment face 113 which extends in the radial direction. As shown in FIG. 5, retaining members 48 and 50 are spaced from one another by spacer member 52 and spacer block 54, and spacer block 54 is held from relative movement therewith by bolt 58 inserted through apertures 78 and 110.

Figure 12:
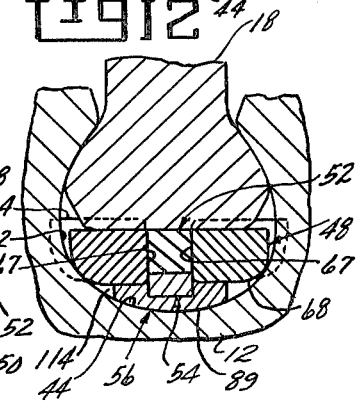
FIG. 12 is a cross-sectional view along line 12—12 of FIG. 6 disclosing the installed spacer in cooperation with the retaining pins and block.

Referring now to FIGS. 6 and 12, the improved locking device 46 is shown in its installed position cooperating with rotor slot 32 and blade tang 18. As can best be seen from FIG. 12, bearing surface 89 of sleeve 56 is in engagement with bottom wall 44 of slot 32. Spacer 52 is positioned within sleeve channel 82 between and in engagement with side 67 of each retainer 48 and 50, thereby serving to space retainers 48 and 50 circumferentially from each other and effecting engagement of sides 70 of retainers 48 and 50 with the walls 42 of slot 32. As is best shown in FIG. 6, spacer 52 has been deformed to a generally straight configuration with spacer block 54 positioned under the forward lug end of spacer 52 within sleeve channel 82 such that wedge portion 104 urges arcuate surface 96 of spacer 52 into engagement with blade tang 18, thereby exerting a radially outwardly directed load upon the tang to retain the blade tang in a fixed radial position with respect to rotor disk 12.

With the improved blocking device 46 in the installed position, abutment surfaces 72 of aft lugs 64 are in confronting and overlapping relationship with outwardly facing abutment surface 40 on the aft side 30 of rotor disk 12 and with the aft end face 24 of blade tang 18. Similarly, at the other end of slot 32, abutment surfaces 74 of forward lugs 66 are in confronting and overlapping relationship with outwardly facing abutment surface 38 on the forward face 28 of rotor 12 and with forward face 22 of blade tang 18. Thus, if any force was applied to blade 10 tending to displace it from slot 32, such displacement would be resisted by the confronting and overlapping relationship of lugs 64 and 66 with respect to the rotor disk 12 and dovetail tank 18. In this manner, with spacer 52 and block 54 inserted, blade 10 is securely locked within slot 32 of rotor 12 and is fixed against relative axial movement with respect to rotor 12.

Figure 7:
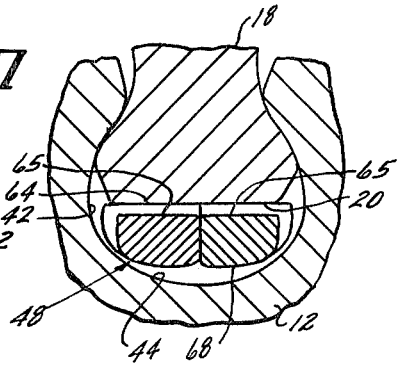
FIG. 7 is a cross-sectional view showing the blade retaining pins during insertion into the rotor slot.

Installation of retaining members 48 and 50 is described in greater particularity in U.S. Pat. No. 3,936,234, the subject matter of which is incorporated herein by reference. Briefly, referring to FIG. 7, retaining members 48 and 50 are shown positioned within slot 32, and it is clear that aft lugs 64 are generally constructed such that they will freely pass through space 24, either one at a time or simultaneously but, in either instance, retaining members 48 and 50 eventually are moved radially and circumferentially outward such that their upper surfaces 65 engage the radially inwardly facing surface 20 on blade tang 18 and such that their circumferentially outwardly facing sides 70 engage side walls 42 of slot 32. Such movement leaves a gap 112 between mutually facing surfaces 67 of stems 62 (FIG. 9) and a space 114 between the lower radially inwardly facing surfaces 68 of retainers 48 and 50 and bottom wall 44 of slot 32. Due to the confronting and overlapping relationship of lugs 64 and 66 with respect to rotor disk 12 and dovetail tang 18 when retaining members 48 and 50 are spread apart, relative axial movement of blade 10 and rotor disk 12 is precluded.

Figure 9:
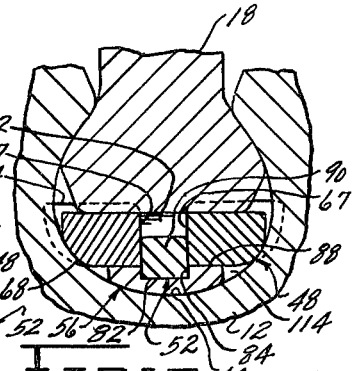
FIG. 9 is a cross-sectional view along line 9—9 of FIG. 8 disclosing the improved spacer member in cooperation with the blade tang, rotor slot and retaining pins.

With the retaining members 48 and 50 in this position, improved spacer member 52 is next inserted into the gap 112 between retainer stem surfaces 67 as shown in FIGS. 8 and 9. Sleeve 56 is next fully inserted into slot 32 and, more particularly, into space 114 between surfaces 68 and slot bottom wall 44 such that its contoured radially inward bearing surface 89 bears upon bottom wall 44 and channel 82 is in general alignment with spacer member 52 between surfaces 67 of stems 62 and with surface 98 bearing generally on surface 82 of sleeve 56.

Spacer 52 is, as previously described, of generally bowed configuration with its convex surface comprising radially outwardly directed arcuate surface 96. As manufactured, spacer 52 is preferably a high-strength metallic alloy of a metal such as, for example, Inconel 718 cold worked to improve its physical properties such that it does not creep at room temperatures or at temperatures associated with normal rotor operation. The spacer height is such that it can be slid under the bottom surface 20 of blade tang 18 and between the tang and the bottom of slot 32 (surface 44) in its relaxed, generally bowed state without deformation of the disk slot 32, or tang 18, or of the spacer itself. Abutment faces 102 of spacer 52 is provided to axially position sleeve 56 in the slot 32 during installation and subsequent operation.

Figure 10:
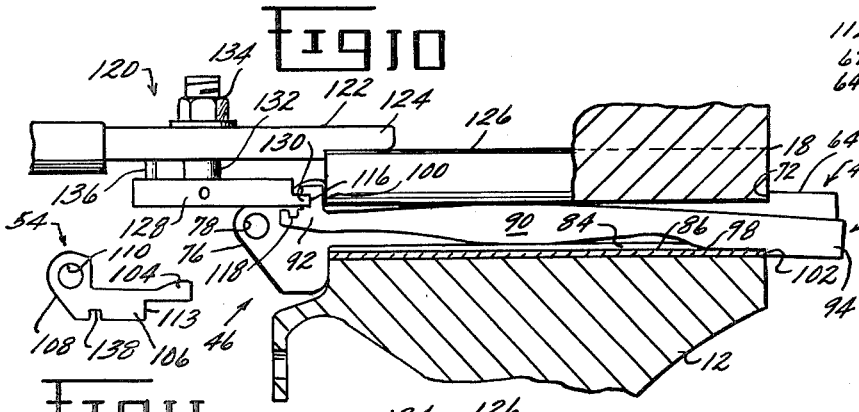
FIG. 10 is a side view depicting schematically how the improved spacer member is deformed by bending with a tool to generate a radially directed load on the blade tang.
Figure 11:
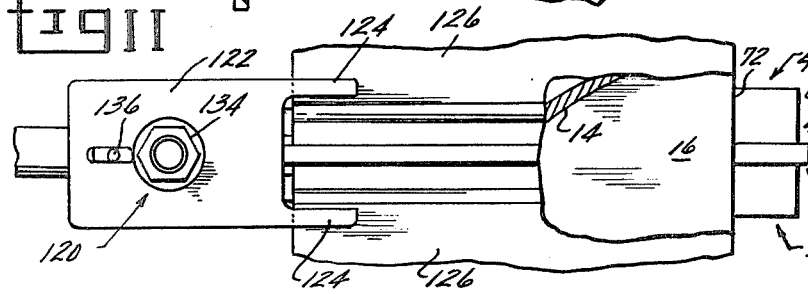
FIG. 11 is a plan form view of the cooperating blade, disk and tool shown in FIG. 10.

A radially outwardly directed load is applied to dovetail tang 18 by deforming spacer 52 to a generally straight configuration as shown in FIGS. 10 through 12. The forward end of spacer 52 is provided with a pair of grooves in lug 92. In particular, groove 116 extends generally axially into lug 92 and groove 118 extends radially inwardly. Groove 116 is adapted to receive a tool indicated generally at 120 which comprises merely one example of a tool which may be used to deform spacer 52 to a generally straight configuration. Tool 120 comprises a rigid arm 122 having a pair of fingers 124 which straddle blade tang 18 and rotor slot 32 and which bear upon the rotor disk lands 126 between adjacent slots 32. The tool also comprises a movable arm 128 having a finger 130 which engages groove 116, the movable arm 128 having an integral threaded shaft 132 attached thereto which protrudes through a hole in rigid arm 122. Shaft 132 and an alignment pin 136 maintain axial alignment of arms 122 and 128, whereas the two arms may be drawn together or moved apart through the camming action of a nut 134 which engages helically threaded shaft 132. If torque is applied to nut 134, finger 130 draws the forward end of spacer 52 radially outwardly, thus tending to straighten the spacer such that abutment surface 100 of lug 92 is in confronting and overlapping relationship with forward end face 22 of tang 18, thus restraining spacer 52 from rearward axial motion, and abutment face 102 of aft lug 94 is in confronting and overlapping relationship with sleeve 56, thereby holding sleeve 56 in a generally fixed axial position with respect to blade 10 and rotor disk 12. Furthermore, the bending of spacer 52 brings arcuate upper surface 96 into abutment with the bottom surface 20 of tang 18 while the arcuate lower surface 98 engages the bottom wall 86 of channel 82, thus generating a radially outwardly directed load upon dovetail tang 18 which is up to 10 times greater than that available from previous blade biasing devices. In one application, a 2,000 lb. load was generated which was sufficient to prevent blade motion during rotor windmilling operation, thereby preventing dovetail wear. The presence of channel sleeve 56 beneath block 54 and spacer 52 provides for the transfer of loads into the rotor disk 12 at the bottom of slot 32 over a large area to prevent wear on the bottom surface 44 while allowing the application of large radial loads. The radius of the arcuate surface 96 of the spacer 52 should be sufficiently large to prevent wear on the bottom surface 20 of dovetail tang 18.

With spacer 52 thus deformed into a generally straight configuration as shown in FIG. 10, spacer block 54 is inserted into the remaining gap 112 beneath the forward end of spacer end 52 and within channel 82 of sleeve 56 such that abutment face 113 of block 54 is in confronting and overlapping relationship with outwardly facing abutment surface 38 on the forward side 28 of rotor disk 12, thereby limiting the extent to which block 54 may be inserted. When the force applied to spacer 52 by tool 120 is relaxed, spacer 52 tends to return to its original generally bowed shape, but is prevented from doing so by block 54 and, in particular, by wedge portion 104 of block 54 which retains spacer 52 in a relatively straight configuration such that the load upon dovetail tang 18 persists (see FIG. 6). Spacer block 54 is held from relative axial movement with respect to retaining members 48 and 50 by bolt 58 inserted through apertures 78 and 110 which, in turn, is retained by nut 60.

Disassembly of the improved retainer 46 is accomplished generally in the reverse manner as described hereinabove. After bolts 58 and nuts 60 are removed, tool 120, or its equivalent, is used to pry the forward end of spacer 52 radially outwardly so that block 54 may be withdrawn from channel 82 of sleeve 86. A groove 134 in the under surface of block 54 provides a means for attaching a hook to aid in the withdrawal process. Tension on spacer 52 may then be relaxed by removal fo tool 120. With spacer 52 in its undeformed, generally bowed shape, it may be withdrawn from channel 82 by means of any hooked device which can engage groove 118 on the forward end of the spacer. Then the sleeve 56, retaining members 48 and 50, and finally the blade 10 may be removed from rotor disk slot 32.

In the fabrication of turbomachinery, it is normal practice to machine cooperating parts only to within generally accepted tolerances. In the present instance, the machining of blade tang 18, rotor slot 32 and retaining members 48 and 50 may result in a slightly loose fit between these parts with the result that rotor blade 10 may exhibit slight radial and angular movement which would tend to produce wear on the tang 18 or rotor disk 12, or both. Through the use of the improved spacer 52 and block 54, load generation to preclude such radial and angular movement is accomplished in bending (rather than compression which characterizes the prior art) to allow for slot and dovetail tang tolerance variations through manufacturing processes or wear (if the present invention is incorporated as a retrofit on existing turbomachinery).

The best mode contemplated for carrying out this invention has been set forth in the description above. In particular, this has been accomplished by setting forth preferred structural arrangements, material of construction and other unobvious variables incident to successful practicing (including making and using) of the invention in the best way contemplated at the time of executing this patent application.

It should be obvious to one skilled in the art that certain changes can be made to the above-described invention without departing from the broad inventive concepts thereof. For example, in some applications it may be possible to delete sleeve 56 and permit spacer 52 to bear directly upon the bottom surface 44 of rotor disk slot 32. It is intended that the appended claims cover this and all other variations in the present invention's broader inventive concepts.

Having thus described the invention, what is claimed and desired to be secured by Letters Patent of the United States is:

1. A blade locking device for locking radially projecting blades in a rotor, each blade having a dovetail tang at its radially inward end and the rotor having dovetail slots extending across its periphery from one side of the rotor to the other, each dovetail tang being received in one of said slots providing a radial space between the tang and the bottom of the slot, wherein the improvement comprises:

a spacer sized to be inserted within the radial space between the tang and the bottom of the slot in a generally undeformed state without deformation of the tang or slot, the spacer having a first generally arcuate surface which abuts the tang when the spacer is deformed after insertion to exert an outwardly directed load on the tang;

blocking means insertable within the slot and under the spacer to retain the spacer in its deformed state after insertion in the slot; and a sleeve received within the slot and under the spacer, said sleeve having a radially inner surface generally contoured to the bottom of the slot which it confronts, and wherein said spacer includes a second generally arcuate surface which abuts the sleeve when the spacer is deformed after insertion within the slot.

2. The improved blade locking device as recited in claim 1 wherein said blocking means is insertable between the spacer and the sleeve.

3. The improved blade locking device as recited in claim 1 wherein said spacer includes a generally bowed central portion with enlarged forward and aft lugs which protrude from said slot, each of said lugs having an inwardly facing abutment surface, one of which confronts and overlays said sleeve and the other of which confronts and overlays an end of the dovetail tang when said spacer is deformed after insertion within the slot.

4. The improved blade locking device as recited in claim 3 wherein said blocking means comprises a block having a wedge portion which is insertable under one of said spacer lugs and an enlarged block lug having an inwardly facing abutment surface which confronts and overlaps said rotor.

5. The improved blade locking device as recited in claim 4 further comprising retaining means for limiting axial movement of the dovetail tang within its respective slot.

6. The improved locking device as recited in claim 5 further comprising fastening means fixedly connecting said block to said retaining means.

7. The improved blade locking device as recited in claim 3 wherein the radial height of said spacer is less than the radial spacer between the tang and the bottom of the slot when said spacer is in its undeformed, generally bowed state.

8. The improved blade locking device as recited in claim 4 wherein the central portion of said spacer is generally tapered in its radial dimension from the aft to the forward end thereof, and wherein the wedge portion of said block is disposed under the end of the spacer proximate the end of the central portion having the smaller radial dimension.

* * * * *